US008555538B2

(12) United States Patent
Huffines

(10) Patent No.: US 8,555,538 B2
(45) Date of Patent: Oct. 15, 2013

(54) FIREARM MAGAZINE HOLSTER

(76) Inventor: Trenton Huffines, Burlington, NC (US)

( * ) Notice: Subject to any disclaimer, the term of this patent is extended or adjusted under 35 U.S.C. 154(b) by 14 days.

(21) Appl. No.: 13/449,533

(22) Filed: Apr. 18, 2012

(65) Prior Publication Data

US 2012/0260554 A1 Oct. 18, 2012

Related U.S. Application Data

(60) Provisional application No. 61/476,598, filed on Apr. 18, 2011.

(51) Int. Cl.
*F42B 39/00* (2006.01)
*F41A 9/24* (2006.01)

(52) U.S. Cl.
USPC ..... 42/49.01; 42/90; 206/3; 224/196; 224/931

(58) Field of Classification Search
USPC ..... 42/49.01, 90; 224/196, 197, 199, 239, 224/240, 587, 931; 206/3, 384
See application file for complete search history.

(56) References Cited

U.S. PATENT DOCUMENTS

| | | | | |
|---|---|---|---|---|
| 5,174,482 | A * | 12/1992 | Rogers et al. | 224/239 |
| 6,050,464 | A * | 4/2000 | Ramsey et al. | 224/196 |
| 7,025,238 | B2 * | 4/2006 | Hughes et al. | 224/671 |
| 7,614,534 | B2 * | 11/2009 | Veo et al. | 224/196 |
| 2006/0022007 | A1 * | 2/2006 | Hughes et al. | 224/671 |
| 2008/0277436 | A1 * | 11/2008 | Wilson | 224/239 |
| 2010/0187271 | A1 * | 7/2010 | Selvetti | 224/196 |
| 2011/0107645 | A1 * | 5/2011 | Faifer | 42/90 |

* cited by examiner

*Primary Examiner* — Bret Hayes
*Assistant Examiner* — Joshua Freeman
(74) *Attorney, Agent, or Firm* — NK Patent Law, PLLC

(57) ABSTRACT

A holster for a firearm magazine is provided. The holster includes a base configured for being secured to a proximally positioned article and a shield carried by the base and defining a void therein for receiving a magazine. The shield has a first position in which the shield encases the magazine and a second position in which the shield does not encase the magazine thereby allowing for ease of access to the magazine for firearm reloading.

18 Claims, 4 Drawing Sheets

FIREARM MAGAZINE HOLSTER

CROSS-REFERENCE TO RELATED APPLICATIONS

This application claims priority to U.S. Provisional Application No. 61/476,598, the entire contents of which is hereby incorporated by reference in its entirety.

TECHNICAL FIELD

This application is directed towards a firearm magazine holster, and more particularly, towards a holster configured for holding a firearm magazine and allowing quick and efficient reloading of a firearm with one hand.

BACKGROUND

Traditional methods of reloading a firearm having a spent magazine have suffered from various disadvantages. Typically, a law enforcement or combat personnel would be required to use two hands to both remove the spent firearm magazine from the firearm while also retrieving a new magazine from a holster. The law enforcement or combat personnel would then have to insert a newly loaded firearm magazine into the firearm. The modern day use of safety devices has added additional steps to this procedure.

These methods have been particularly problematic for law enforcement and combat personnel that may have one hand occupied by holding, for example, a shield. In other instances, a law enforcement or combat personnel may have had one hand injured and could not easily reload their firearm. Additionally, these methods are time-consuming, cumbersome, and require law enforcement or combat personnel to focus their attention on reloading the firearm instead of at enemy or combatant fire.

Accordingly, a new method or device of reloading a firearm having a magazine is needed.

SUMMARY

According to one aspect disclosed herein, a holster for a firearm magazine is provided. The holster includes a base configured for being secured to a proximally positioned article and a shield carried by the base and defining a void therein for receiving a magazine. The shield has a first position in which the shield encases and secures the magazine and a second position in which the shield does not encase the magazine thereby allowing for ease of access to the magazine for firearm reloading.

According to another aspect disclosed herein, the shield is configured for slideable movement from the first position to the second position.

According to another aspect disclosed herein, the shield defines an upper portion having an angle configured to guide the firearm into the void.

According to another aspect disclosed herein, the shield includes a tensioning mechanism that provides a biasing force for biasing the shield into the first position.

According to another aspect disclosed herein, the shield includes a tensioning mechanism that provides a biasing force for biasing the magazine within the void.

According to another aspect disclosed herein, the base defines at least one elongate slot that cooperatively receives a guide for providing the slideable movement.

According to another aspect disclosed herein, the base carries a stop configured for engaging a bottom portion of a magazine, and further wherein the shield includes a threaded fastener extending through the bottom portion of the shield for contacting a bottom portion of the magazine and altering the angle of the magazine.

According to another aspect disclosed herein, the holster includes a mounting mechanism on a back surface of the base for securing the holster to a proximally positioned article.

According to another aspect disclosed herein, the proximally positioned article is an article of clothing.

According to another aspect disclosed herein, the proximally positioned article is a second weapon.

According to another aspect disclosed herein, a method of reloading a firearm using the magazine holster is provided. The method includes positioning a firearm magazine in the void, positioning a firearm configured for receiving a magazine proximal to the magazine holster until the firearm contacts the shield and imparts movement thereof from the first position to the second position, and positioning the firearm until the firearm magazine is received therein.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DESCRIPTION

Figure 2:
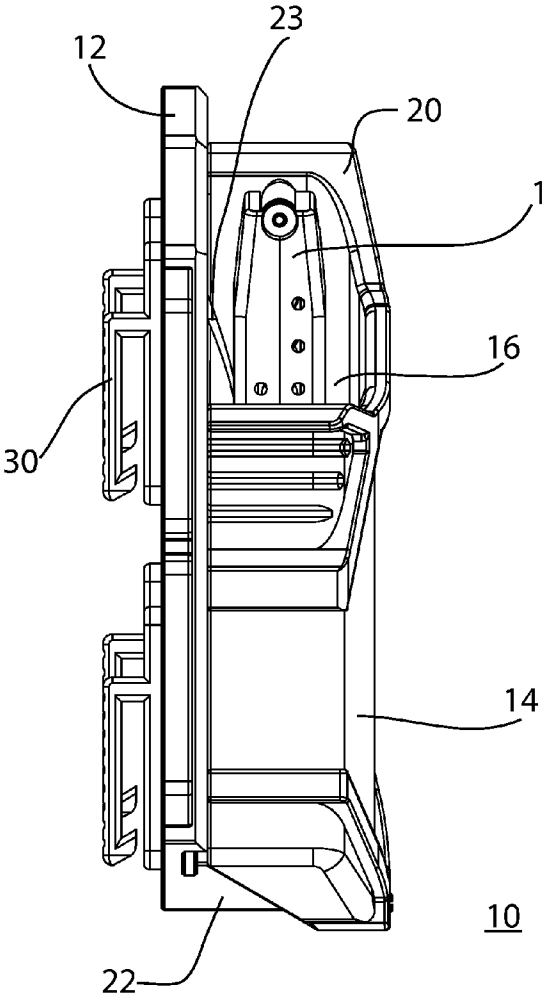
FIG. 2 is a side view of a firearm magazine holster in a first position according to an embodiment of the present invention.

The presently disclosed subject matter now will be described more fully hereinafter with reference to the accompanying drawings, in which some, but not all embodiments are shown. Indeed, the one or more embodiments disclosed herein may be embodied in many different forms and should not be construed as limited to the embodiments set forth herein; rather, these embodiments are provided so that this disclosure will satisfy applicable legal requirements. Like numbers refer to like elements throughout.

Referring now specifically to the drawings, a firearm magazine holster is shown throughout FIGS. 1 through 6 and is generally designated 10. The holster 10 is for carrying a firearm magazine 1. The holster 10 may include a base 12 configured for being secured to a proximally positioned article 31, 32. The holster 10 may include a shield 14 carried by the base and defining a void 16 therein for receiving a magazine 1.

The shield 14 defines an upper portion having an angled portion 20 configured to guide the firearm into the void 16 when the user desires to replace a spent magazine as will be further described herein.

Figure 6:
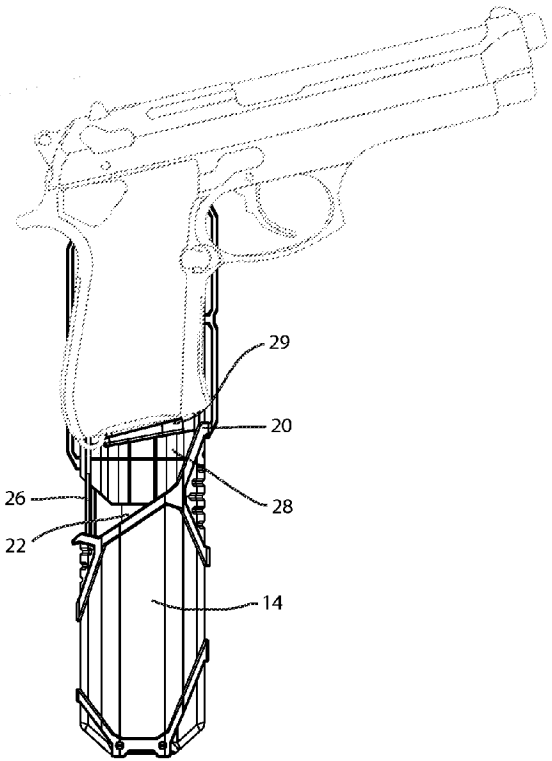
FIG. 6 is a side view showing the firearm magazine holster in the second position in which the firearm is receiving a reloaded magazine.
Figure 5:
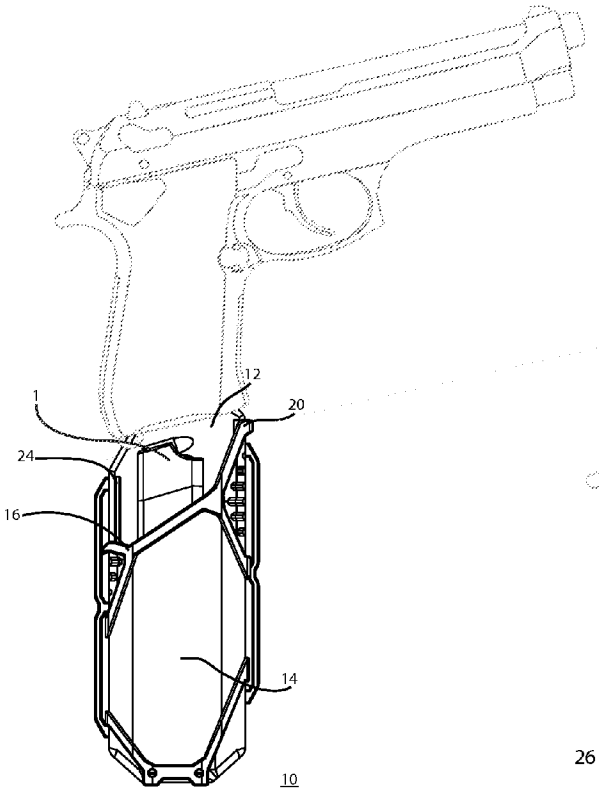
FIG. 5 is a side view showing the firearm magazine holster in the first position in which a firearm is closely-spaced.
Figure 8:
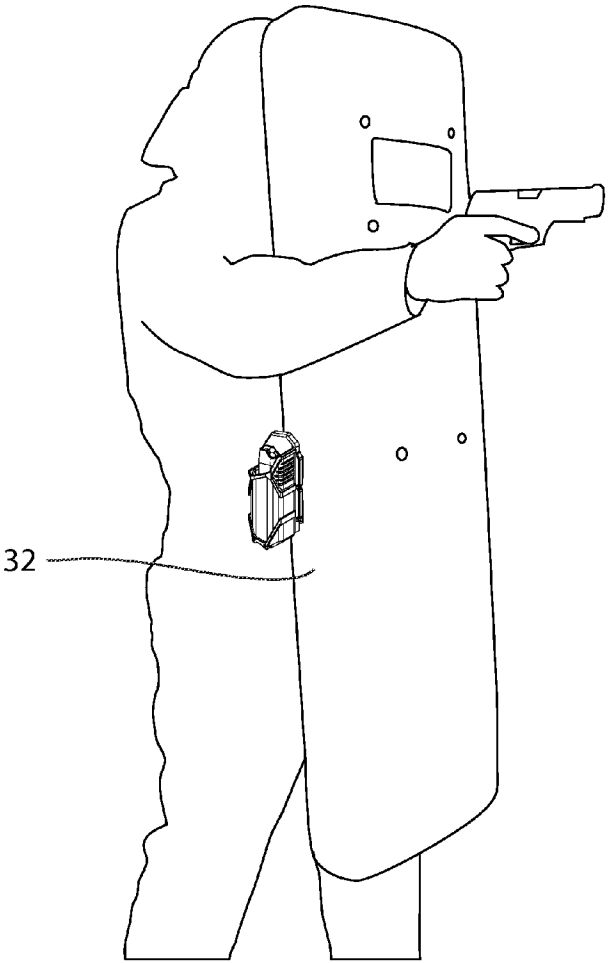
FIG. 8 is a perspective view of the firearm magazine holster in use and being carried by another weapon, specifically a shield.
Figure 7:
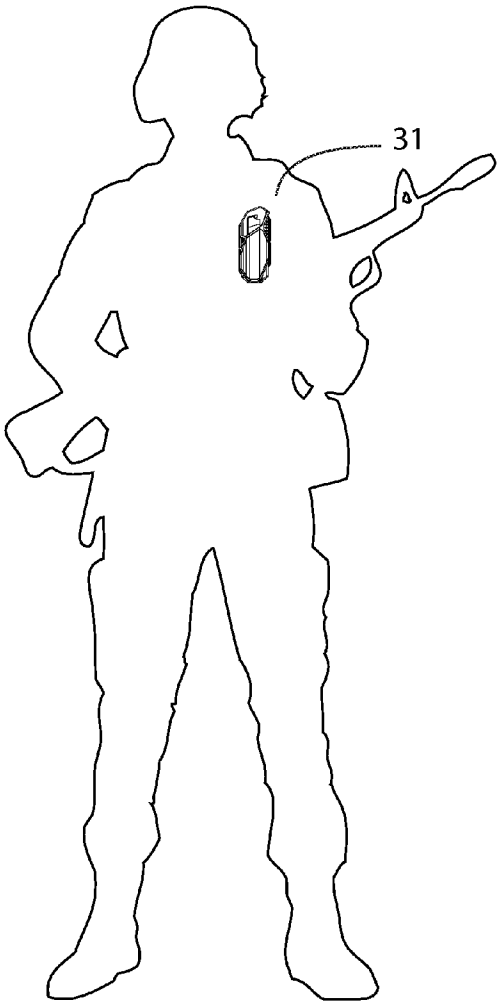
FIG. 7 is a front view of the firearm magazine holster in use, and being carried by an article of clothing.

The holster 10 includes an attachment device 30 on a back surface of the base for securing the holster 10 to a proximally positioned article 31, 32. The proximally positioned article, as illustrated in FIG. 5 and FIG. 6, may be an operator's clothing, shield being carried by an operator, or any article to which the attachment device 30 can be attached to. The attachment device 30 is depicted as a clip, but may be any appropriately configured device provided for permanent or temporary placement with the article.

Figure 1:
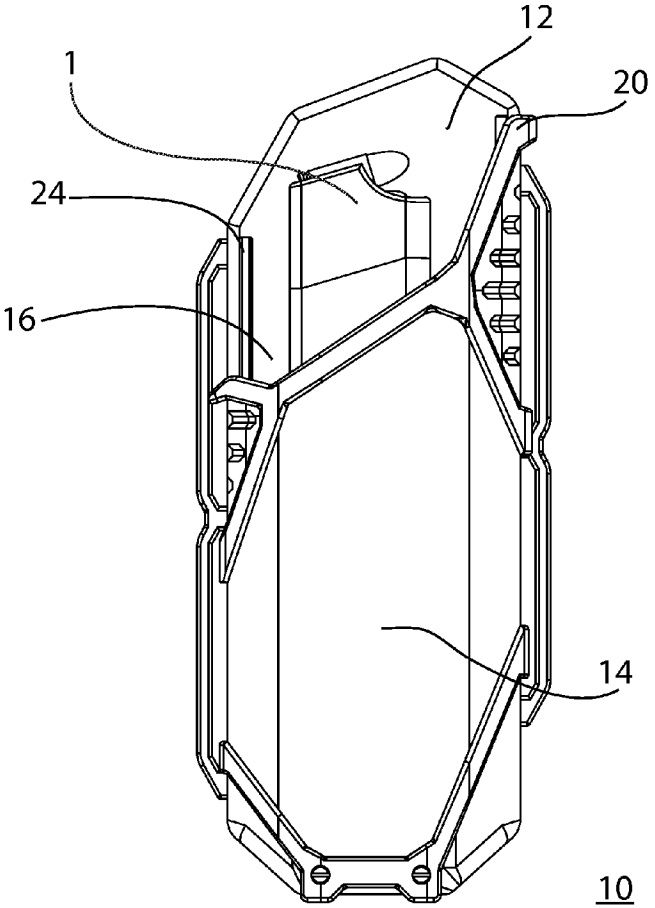
FIG. 1 is a front view of a firearm magazine holster in a first position according to an embodiment of the present invention.
Figure 4:
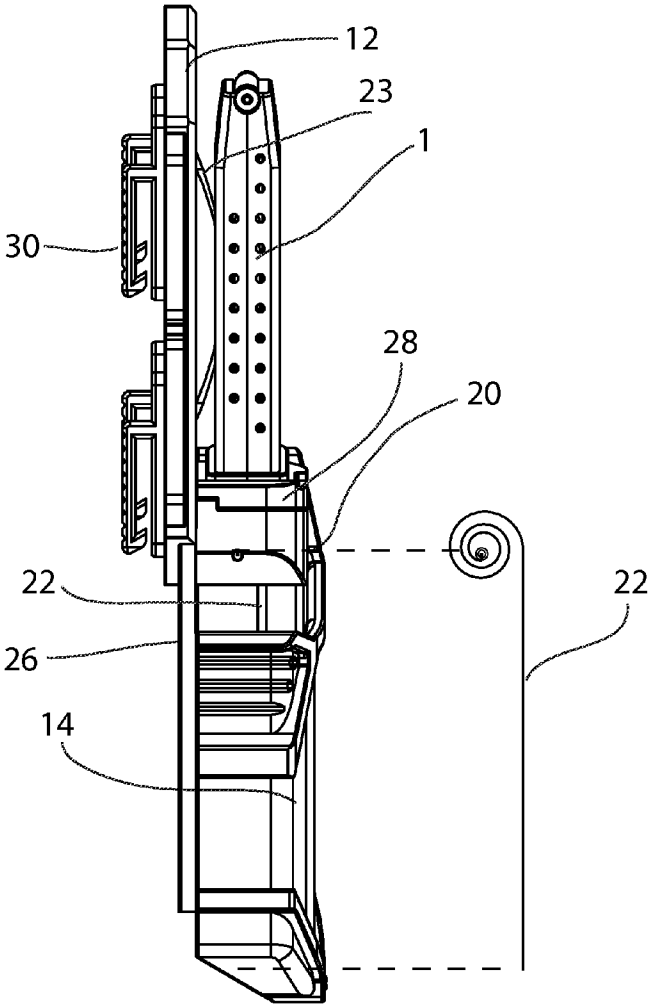
FIG. 4 is a side view showing the firearm magazine holster in a second position according to an embodiment of the present invention.
Figure 3:
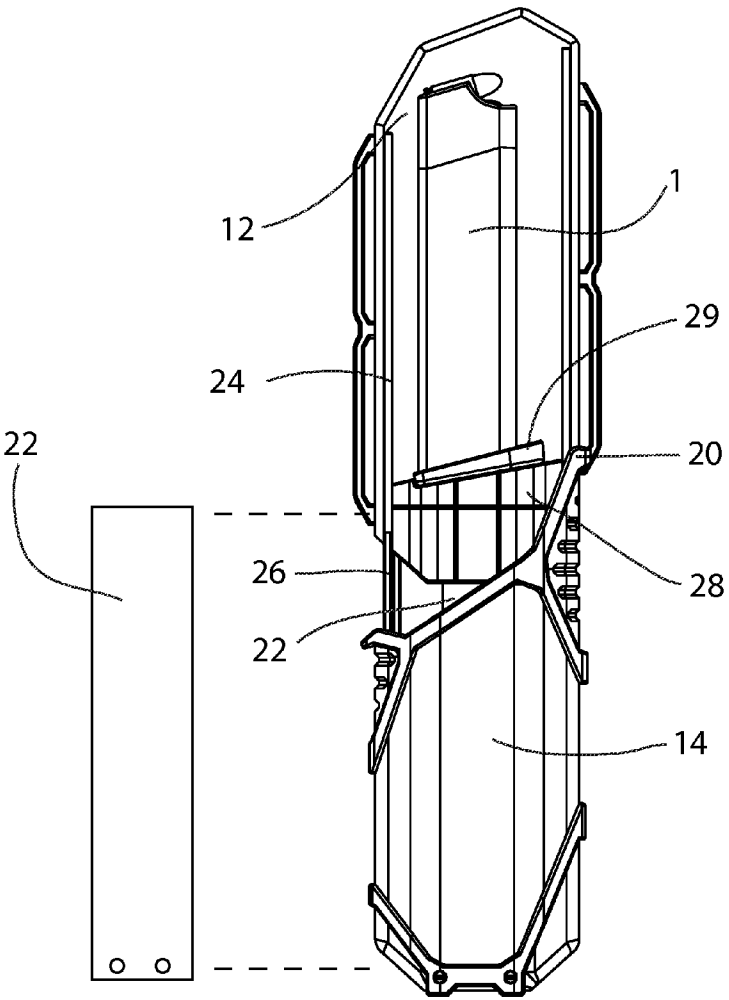
FIG. 3 is a front view showing the firearm magazine holster in a second position to an embodiment of the present invention.

As illustrated in FIG. 1 and FIG. 1, the shield 14 has a first position in which the shield 14 substantially encases the magazine 1. As illustrated in FIG. 3 and FIG. 4, the shield 14 has a second position in which the shield 14 does not substantially encase the magazine 1 thereby allowing for ease of access to the magazine 1 for firearm reloading.

The shield 14 is configured for slideable movement from the first position to the second position. As illustrated in FIG. 3 and FIG. 4, the base 12 defines at least one elongate slot 24 that cooperatively receives a guide 26 carried by the shield 14 for providing the slideable movement. The shield 14 includes a tensioning mechanism 22 that provides a biasing force for biasing the shield 14 into the first position. The tensioning mechanism 22 may include a resilient band or the like. The base may carry a second tensioning mechanism 23 that provides biasing force for biasing the magazine 1 to a position inside the void 16. The base 12 may carry a stop 28 configured for engaging a bottom portion 29 of the magazine 1. The stop 28 may include a threaded fastener extending through the bottom portion of the stop 28 for contacting the bottom portion 29 of the magazine 1 and altering the angle of the magazine 1 relative to the holster 10.

This section is referring now specifically to a method of use for the one or more firearm magazine holsters (10) described above, and shown throughout FIGS. 1 through 6. A user secures the firearm magazine holster (10) to a proximally positioned article 31, 32 before engaging in a conflict, training, or the like. The user positions a magazine 1 in the void 16 such that the bottom portion 29 of the magazine contacts with the stop 28. While engaged in a conflict, and, in one or more embodiments, having exhausted the ammunition in the magazine of a firearm, the user ejects the spent magazine from the firearm. While using the hand that is holding the firearm, the user then positions the firearm over the firearm magazine holster 10 in a manner directly in-line with the magazine 1 as illustrated in FIG. 4. Applying downward force, the user moves the firearm downward onto the magazine 1, contacting the shield 14, and thereby causing the shield 14 to slide from the first position to the second position. The magazine 1 is then substantially unobstructed by the shield 14 such that the user is able to slide the firearm over the magazine 1 until the magazine is received within the firearm. The user continues to apply downward force with the firearm, further inserting the magazine 1 into the firearm until the magazine 1 is fully engaged inside the magazine well of the firearm. The user now removes the firearm from the firearm magazine holster (10), chambers the ammunition from the newly inserted magazine (1) into the firearm, and continues their engagement in the conflict.

A firearm magazine holster and method for using the same is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

The invention claimed is:

1. A holster for a firearm magazine comprising: a base configured for being secured to a proximally positioned article; and a shield carried by the base and defining a void therein for receiving a magazine, the shield having a first position in which the shield encases the magazine and a second position in which the shield does not encase the magazine, wherein the shield is configured for slideable movement from the first position to the second position, thereby allowing for ease of access to the magazine for firearm reloading.

2. The holster according to claim 1, wherein the shield defines an upper portion having an angled portion configured to guide the firearm into the void.

3. The holster according to claim 1, wherein the shield includes a tensioning mechanism that provides a biasing force for biasing the shield into the first position.

4. The holster according to claim 1, wherein the base defines at least one elongate slot that cooperatively receives a guide for providing for the slideable movement.

5. The holster according to claim 1, wherein the base carries a stop configured for engaging a bottom portion of the magazine, and further wherein the stop includes a threaded fastener extending through the bottom portion of the stop for contacting a bottom portion of the magazine and altering the angle of the magazine.

6. The holster according to claim 1, further comprising a mounting mechanism on a back surface of the base for securing the holster to a proximally positioned article.

7. The holster according to claim 1, wherein the proximally positioned article is an article of clothing.

8. The holster according to claim 1, wherein the proximally positioned article is a second weapon.

9. The holster according to claim 1, said device being manufactured from a material selected from the group of materials consisting of metals, polymers, composites, and combinations thereof.

10. A method of reloading a firearm using the magazine holster according to claim 1, the method comprising:

positioning a firearm magazine in the void;

positioning a firearm configured for receiving a magazine proximal to the magazine holster until the firearm contacts the shield and imparts movement thereof from the first position to the second position; and positioning the firearm until the firearm magazine is received therein.

11. A holster for reloading a firearm magazine, the holster comprising:

a casing having a volume therein for receiving the firearm magazine;

a shield carried by the casing for enclosing a majority of the firearm magazine when the shield is in a first position, the shield being slideably spaced-away into a second position in which the magazine is substantially free of the shield to allow receiving of the magazine by a firearm.

12. The holster according to claim 11, wherein the shield defines an upper portion having an angled portion configured to guide the firearm into the void.

13. The holster according to claim 11, wherein the shield includes a tensioning mechanism that provides a biasing force for biasing the shield into the first position.

14. The holster according to claim 11, wherein the base defines at least one elongate slot that cooperatively receives a guide for providing for the slideable movement.

15. The holster according to claim 11, wherein the base carries a stop configured for engaging a bottom portion of the magazine, and further wherein the stop includes a threaded fastener extending through the bottom portion of the stop for contacting a bottom portion of the magazine and altering the angle of the magazine.

16. The holster according to claim 11, further comprising a mounting mechanism on a back surface of the base for securing the holster to a proximally positioned article.

17. The holster according to claim 11, wherein the proximally positioned article is an article of clothing.

18. The holster according to claim 11, wherein the proximally positioned article is a second weapon.

* * * * *